US008821660B2

(12) United States Patent
Huang

(10) Patent No.: US 8,821,660 B2
(45) Date of Patent: Sep. 2, 2014

(54) METHOD FOR MANUFACTURING ECOTYPIC ARTIFICIAL LEATHER OR LEATHER-LIKE AND AUTOMATED MANUFACTURING LINE THEREOF

(76) Inventor: Chengyuan Huang, Zhejiang (CN)

( * ) Notice: Subject to any disclaimer, the term of this patent is extended or adjusted under 35 U.S.C. 154(b) by 684 days.

(21) Appl. No.: 13/061,145

(22) PCT Filed: Aug. 28, 2009

(86) PCT No.: PCT/CN2009/000980
§ 371 (c)(1),
(2), (4) Date: Feb. 26, 2011

(87) PCT Pub. No.: WO2010/022589
PCT Pub. Date: Mar. 4, 2010

(65) Prior Publication Data

US 2011/0165324 A1 Jul. 7, 2011

(30) Foreign Application Priority Data

Aug. 29, 2008 (CN) ..... 2008 1 0212725

(51) Int. Cl.
*B32B 5/20* (2006.01)
*B29C 44/28* (2006.01)
*D06N 3/14* (2006.01)
*D06N 3/00* (2006.01)

(52) U.S. Cl.
CPC ..... *D06N 3/14* (2013.01); *D06N 3/0043* (2013.01); *D06N 3/0097* (2013.01); *D06N 2205/20* (2013.01); *D06N 2205/22* (2013.01); *D06N 2211/28* (2013.01)
USPC ..... 156/78; 156/79; 156/246; 156/247

(58) Field of Classification Search
USPC ..... 156/78, 79, 246, 247
See application file for complete search history.

(56) References Cited

U.S. PATENT DOCUMENTS 3,328,225 A * 6/1967 Urbanic et al. ..... 442/221
3,697,205 A * 10/1972 Ross et al. ..... 425/4 R
(Continued)

FOREIGN PATENT DOCUMENTS

CN 1439765 A 9/2003
CN 1754896 A 4/2006
(Continued)

OTHER PUBLICATIONS

English Translation of International Preliminary Report on Patentability from International Application PCT/CN2009/000980, Date Unknown.*

*Primary Examiner* — Michael Tolin
(74) *Attorney, Agent, or Firm* — Global IP Service; Tianhua Gu

(57) ABSTRACT

A method for manufacturing ecotypic artificial leather or leather-like includes the following steps: a first step of forming a surface layer; a second step of spray foaming which is to coat the partly cured surface layer with a reactive solvent-free multicomponent polymer using a multicomponent reaction injection molding device and a spray gun; a third step of once-molding roller pressing which is to press the substrate, foaming layer, surface layer and release paper together between the multicomponent polymer foaming stage and curing stage using a roller press device; and a fourth step of maturing and stripping, in which the substrate, foaming layer, surface layer and release paper are heated up, and then are cooled down while the release paper is removed. The production process utilizing the manufacturing method described in this invention is totally environmentally friendly. The physical and chemical properties of the product are excellent. The equipment utilized has high degree of automation and is easy to industrialize.

7 Claims, 3 Drawing Sheets

(56) References Cited

U.S. PATENT DOCUMENTS

| | | | | |
|---|---|---|---|---|
| 3,794,548 | A * | 2/1974 | Wirth et al. | 428/91 |
| 4,643,082 | A * | 2/1987 | Lynham et al. | 454/54 |
| 2006/0240193 | A1* | 10/2006 | Failla | 427/372.2 |
| 2007/0128372 | A1* | 6/2007 | Wirth et al. | 427/421.1 |
| 2007/0129456 | A1* | 6/2007 | Cha et al. | 521/172 |
| 2008/0214727 | A1* | 9/2008 | Pohl et al. | 524/589 |
| 2009/0311480 | A1* | 12/2009 | Fischer et al. | 428/160 |

FOREIGN PATENT DOCUMENTS

| | | | |
|---|---|---|---|
| CN | 1978781 | A | 6/2007 |
| WO | WO 2006/097508 | A1 * | 9/2006 |
| WO | WO 2008/017446 | A1 * | 2/2008 |
| WO | PCT/CN2009/000980 | | 12/2009 |

* cited by examiner

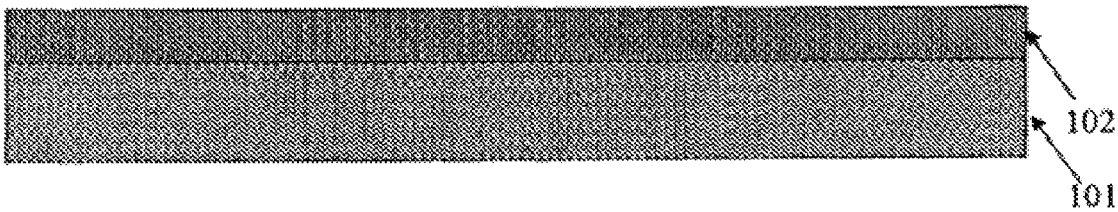
FIG. 2 A-A
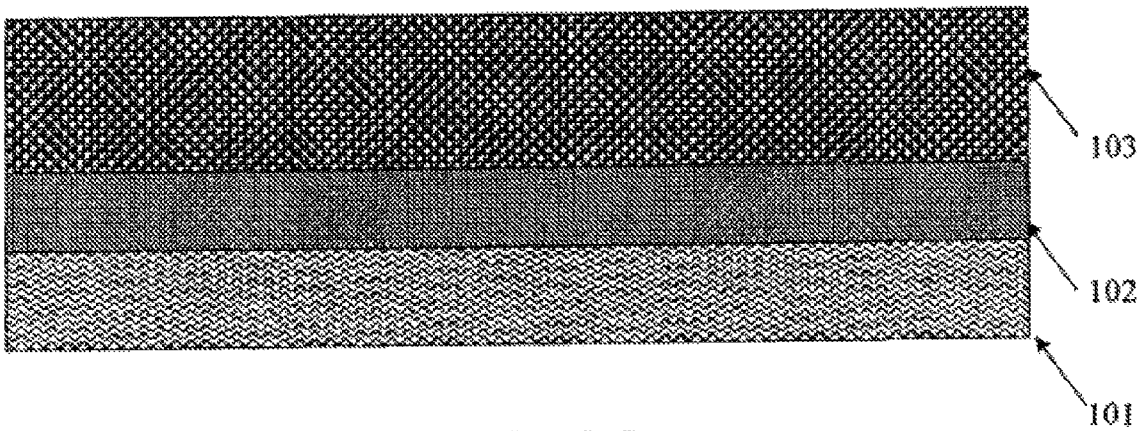
FIG. 3 B-B

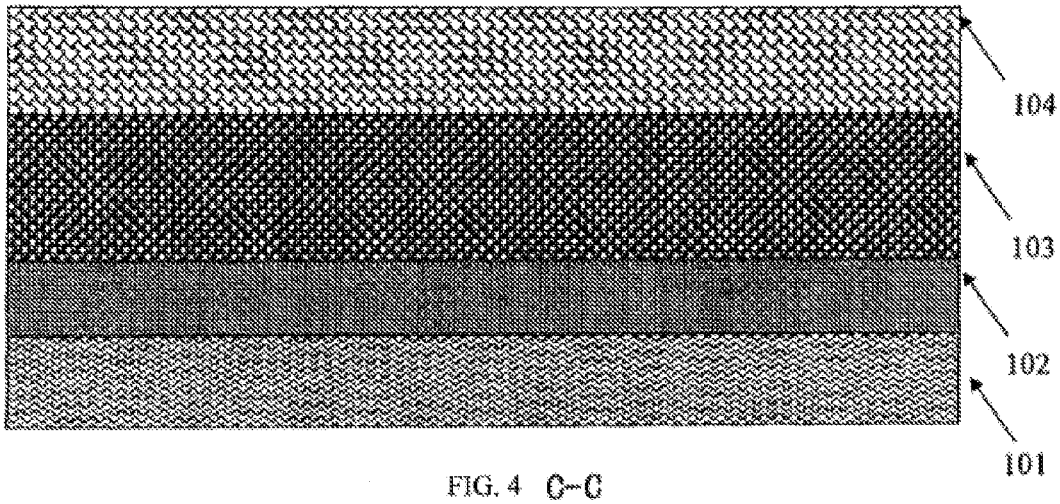
FIG. 4 C-C
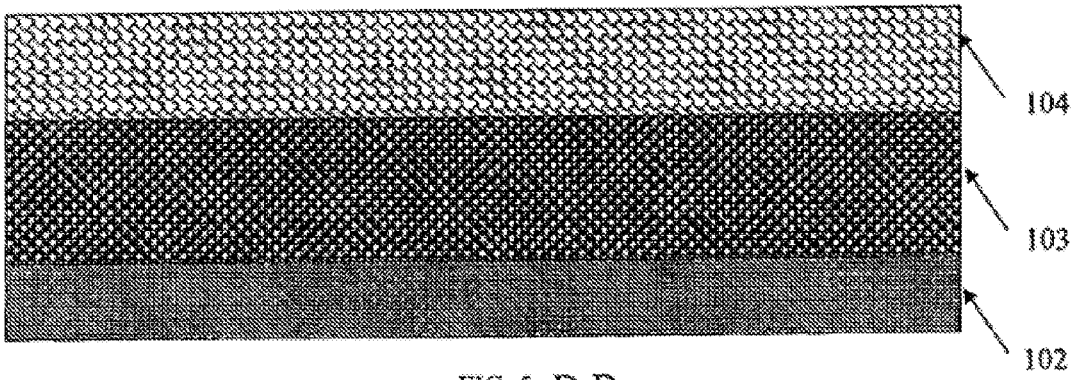
FIG. 5 D-D

METHOD FOR MANUFACTURING ECOTYPIC ARTIFICIAL LEATHER OR LEATHER-LIKE AND AUTOMATED MANUFACTURING LINE THEREOF

CROSS REFERENCE TO RELATED PATENT APPLICATION

The present application is the US national stage of PCT/CN2009/000980 filed on Aug. 28, 2009, which claims the priority of the Chinese patent application No. 200810212725.1 filed on Aug. 29, 2008, which application is incorporated herein by reference.

FIELD OF THE INVENTION

The present invention relates to a method for manufacturing ecotypic leather or leather-like (such as wallpaper) and automated assembly line thereof, especially to a method and assembly line thereof for manufacturing once-molding ecotypic leather or leather-like with a surface coating layer, a polymer foaming layer and the substrate. The production process includes a step of coating which is to spray a reactive solvent-free multicomponent polymer in a sealed spray chamber utilizing a multicomponent reaction injection molding (RIM) device and a multicomponent automated mixing spraying self-cleaning spray-gun technology.

BACKGROUND OF THE INVENTION

Artificial leather or leather-like have been widely used in the production of clothing and leather shoes. Currently the leather or leather-like manufacturing processes utilize a variety of combinations of different making processes according to the different uses of the product. In general, a product whose appearance is like leather is made by coating the surface of a selected substrate with one or multiple layers of synthetic resins containing various additives. The wet-coagulation method is normally used to manufacture artificial leather or leather-like flakes. The process mainly comprises the steps of: coating a substrate with an organic solvent-based resin composition; immersing the treated substrate in a immersion tank with an aqueous solution of dimethylformamide (DMF); curing the surface of the treated substrate from the previous step in a water tank; forming an artificial leather substrate by drying out the product from the previous step in a drying oven; and bonding a surface layer which is made separately to the finished substrate using a binding agent.

While during the wet-coagulation process, many organic solvents, such as toluene, xylene, acetone, methyl ethyl ketone (MEK), ethyl acetate, DMF, etc., are used extensively to make the substrate, surface layer or binding agent; and many chemicals, such as plasticiser vapours (dioctyl phthalate, etc.), vinyl chloride, hydrogen chloride, organic solvents, lead, toxic dioxin, etc., are used or produced in the utility of polyvinyl chloride (PVC) related techniques. The above hazardous chemical substances pose various threats to human health, which is discussed in the following. Aromatic solvent such as toluene has toxic effect on hematopoietic organs. And long-term exposure to high concentrations of aromatic solvent may cause shock because of acute poisoning, or cause the reduction in platelet or white blood cell because of chronic poisoning, which leads to a variety of symptoms of illness. Xylene is highly flammable and explosive, which is easily ignited by heat, sparks or flames and becomes the cause of fire. Butanol, MEK, acetone, ethyl acetate, DMF and other solvents have considerable toxic side effects on human health. Ethyl acetate may cause narcosis or eye irritation. DMF which is the most extensively used solvent in the production of artificial leather may cause acute irritation to skin and ophthalmic mucous membranes. Inhalation of high concentrations of DMF vapour may cause nausea because of respiratory tract irritation. And frequent exposure to DMF, via dermal absorption, may lead to hepatic dysfunction. In addition, organic solvents may have negative effects on a woman's reproductive health. Although most factories are now using the solvent treatment equipment to recycle the solvent, a small amount of solvent waste from wet-style production process and a large amount of solvent waste from dry-style production process are still discharged directly into the surrounding water and air, which heavily pollutes the local environment and poses significant threats to the local production, life and public health.

In order to solve the above issues, new processes of manufacturing artificial leather or leather-like have been developed, e.g., a process in which organic solvents are replaced with water based materials. The process of making artificial leather which utilizes a water based resin is safe and clean, and the finished product is non-toxic as well as green. But there exist quite a few issues on the popularization of the process. One issue is that water based resin has inappropriate physical properties, such as high value of surface tension which causes spreading difficulty, slow volatility which causes drying difficulty, etc. Another issue is that there still exist quite a few problems during production, such as the equipment problem, the technical problem of leather processing, the problem of water based additive material matching, the problem of whether or not release paper is applicable, etc. In addition, the finished product feels uncomfortable against the skin and needs to be improved in terms of properties, such as resistance to wear, resistance to scratch, resistance to heat, resistance to durability, resistance to acid and alkali, resistance to solvent, resistance to wet abrasion, tensile strength, etc. Another evolved process of making artificial leather involves roller or knife coating release paper with a foamed mixture which is formed by fast stirring a few quantitatively mixed molecular designed compounds at an appropriate temperature. The artificial leather made through the process is environmentally friendly and has excellent physical and chemical properties. But the process involves a very long-time maturing step, uses equipment with huge footprint, has low productivity, is difficult to industrialize.

SUMMARY OF THE INVENTION

The objective of the invention is to provide a method for manufacturing ecotypic artificial leather or leather-like and automated assembly line thereof. The method is totally environmentally friendly because of not using any solvent during production process. The method increases productivity by applying the artificial leather or leather-like once molding technology. The product manufactured using the method feels comfortable against the skin, and has excellent physical or chemical properties such as permeability to water vapour, resistance to durability, resistance to wet abrasion, high tensile strength, etc. The automated assembly line has high degree of automation, comprises a short-cycle production line, makes possible low average energy consumption for each manufactured product, is easy to industrialize.

A preferred embodiment of the present invention is a method for manufacturing ecotypic artificial leather or leather-like, which comprises the following steps:

A step of forming a surface layer: to utilize a conveyor to convey release paper with predesigned lines along a scheduled direction, then to utilize a coating device to coat the release paper with a water based finishing material and drying it in a drying device, which is to form a partly cured surface layer on the release paper;

A step of spray foaming: to coat the partly cured surface layer with a reactive solvent-free multicomponent polymer utilizing a multicomponent reaction injection molding (RIM) device and a spray gun in a sealed spray chamber system, which is to form a foaming layer on the surface layer; A step of roller pressing: to once molding press the substrate, foaming layer and surface layer together between the multicomponent polymer foaming stage and curing stage using a roller press device; A step of maturing and stripping: to heat up the treated substrate, foaming layer and surface layer, then to cool them down while the release paper is removed.

The above embodiment of the present invention of a method for manufacturing artificial leather or leather-like, wherein the component materials of the multicomponent polymer belong to polyurethane family and there is not any solvent in them.

The above embodiment of the present invention of a method for manufacturing artificial leather or leather-like, wherein the spray foaming step further to include: heating up a component material A which is in semi solid or solid state at room temperature using a preheating tank, then measuring, temperature controlling, pressurizing and conveying A along with other component materials using a speed-adjustable ratio-variable high-precision pump and a conveyor system, during which the operating temperature is between 30° C. and 80° C.

The above embodiment of the present invention of a method for manufacturing artificial leather or leather-like, wherein the spray foaming step further to include: uniform downward vertical ventilation utilizing a ventilator fixed on the ground, which makes the surface layer coated uniformly with the atomized multicomponent polymer, of which the foaming layer is formed.

The above embodiment of the present invention of a method for manufacturing artificial leather or leather-like, wherein, in the maturing and stripping step, the curing and maturing processes of the product are accelerated by applying electric heating circulation thermal convection under a condition of that the oven operating temperature is between 70° C. and 130° C.

The above embodiment of the present invention of a method for manufacturing artificial leather or leather-like, wherein the spray gun is that the multicomponent automated mixing spraying self-cleaning spray gun.

The above embodiment of the present invention of a method for manufacturing artificial leather or leather-like, wherein, in the spray foaming step, the applied coating mode is the dual-gun reciprocating overlay mode.

The above embodiment of the present invention of a method for manufacturing artificial leather or leather-like, wherein the temperature, humidity and air flow are constant in the sealed spray chamber system.

Another preferred embodiment of the present invention is an automated assembly line for manufacturing ecotypic artificial leather or leather-like, which includes:

A conveyor: starting from the unwinding shelves of release paper and substrate, finishing at the winding shelves of the release paper and substrate, and having a number of conveyor rollers installed.

A surface layer forming device: including a coating device through which release paper is coated with a water based finishing material, and a drying device in which the treated release paper is dried.

A sealed spray chamber system: containing one or more multicomponent reaction injection molding devices and one or more spray guns, which are utilized to coat a partly cured surface layer with multicomponent polymers, of which a foaming layer is formed.

A roller pressing device: being used to once molding press the substrate, foaming layer and surface layer together between the multicomponent polymer foaming stage and curing stage.

A heat treatment device: including an oven used for heating and a cold air chamber used for cooling.

The above embodiment of the present invention of an automated assembly line, wherein the sealed spray chamber system further to include a ventilator fixed on the ground, which is used for uniform downward vertical ventilation that makes the surface layer coated uniformly with the atomized multicomponent polymer.

The above embodiment of the present invention of an automated assembly line, wherein the temperature, humidity and air flow are constant in the sealed spray chamber system.

The above embodiment of the present invention of an automated assembly line, wherein the spray gun is the multicomponent automated mixing spraying self-cleaning spray gun. The above embodiment of the present invention of an automated assembly line, wherein the oven is set to electric heating circulation thermal convection mode.

Compared with the existing process, the process in the present invention not only can achieve zero emissions of VOC in production, which avoids the investment in expensive waste, such as gas, water, etc., treatment equipment and the high energy consumption pollution boiler, but also can be a totally clean and safe one as a result of not using any flammable solvent-containing binding agent. In addition, the process overcomes the equipment and technical problems of applying automated coating technique for manufacturing artificial leather or leather-like with 100% solid content polymer materials. Because the present invention uses a sealed ventilation spray chamber system with constant temperature and humidity, the work environment is stable in terms of temperature, humidity and air flow, which ensures the multicomponent polymer mixture foaming react evenly, thereby let the finished product have the best properties and the most stable quality. The present invention is the first to introduce production and combination of the substrate, foaming layer and surface layer on one assembly line, which makes possible once molding manufacture of artificial leather and leather-like, thus the production costs, such as costs of plants, equipment, labours, resources, etc., are reduced. The automated assembly line in the present invention increases the degree of automation in production of artificial leather or leather-like, ensures the accuracy of operations, has a high degree of intra-cooperation, has high productivity, and is easy to industrialize.

BRIEF DESCRIPTION OF THE DRAWINGS

FIG. 2 is a sectional view along the A-A direction of FIG. 1 in the present invention;

FIG. 3 is a sectional view along the B-B direction of FIG. 1 in the present invention;

FIG. 4 is a sectional view along the C-C direction of FIG. 1 in the present invention;

FIG. 5 is a sectional view along the D-D direction of FIG. 1 in the present invention.

DETAILED DESCRIPTION OF THE INVENTION

Figure 1:
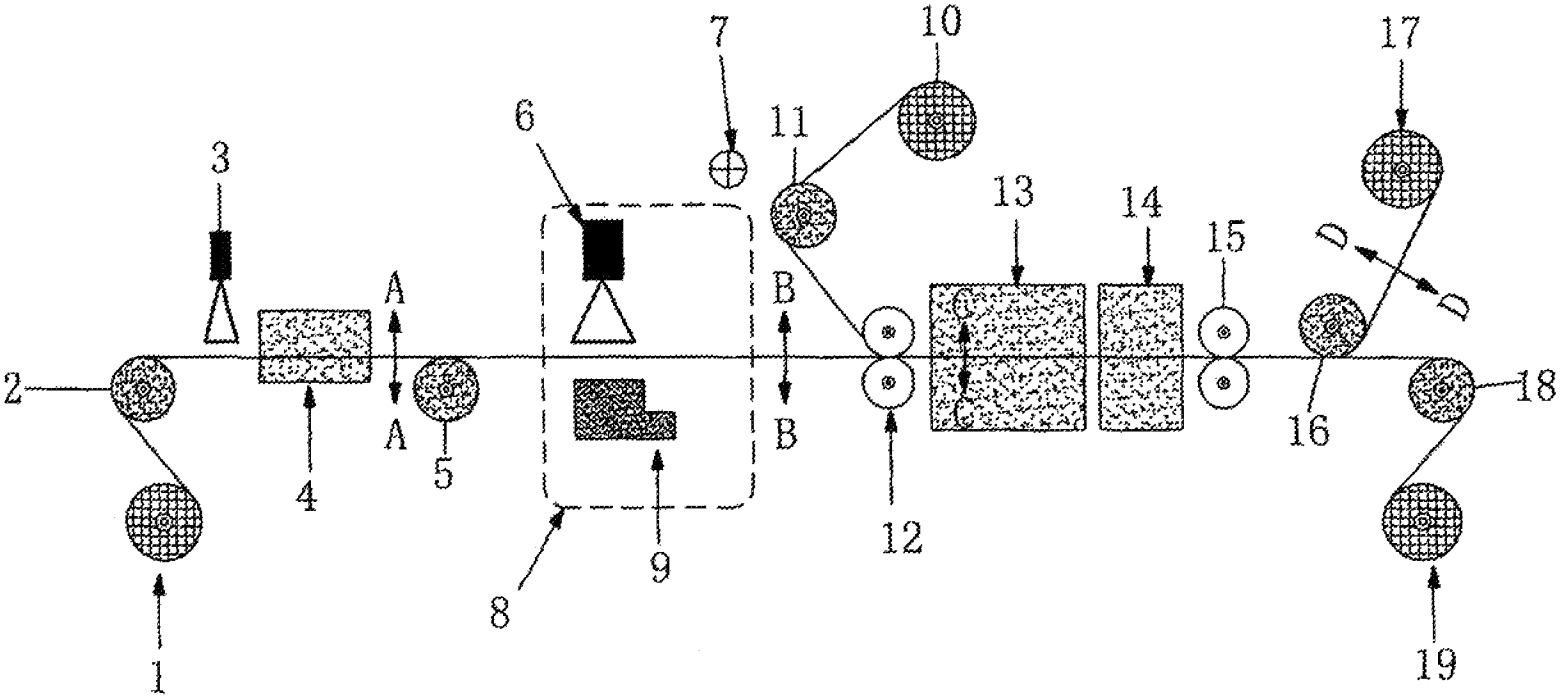
FIG. 1 is a flowchart of manufacturing process of ecotypic artificial leather or leather-like in the present invention.

It is easy to understand that methods or assembly lines with similar implementations or structures may be made according to the illustrations of the preferred embodiment without departing from the scope or the spirit of the present invention. So the following specific implementation and illustration is only from a preferred embodiment of technical solution in the present invention, and should not be considered as the whole of the present invention or the technical solution limits or restrictions of the present invention.

As shown in FIG. 1 to FIG. 5, a preferred embodiment of the present invention of a method for manufacturing ecotypic artificial leather or leather-like mainly includes the following stages: The first stage: to unwind release paper with predesigned lines facing upward or a similar thing around a shelf 1, then convey the unwound release paper forward via a conveying device, which is a conveyor roller 2 shown in FIG. 1 in this illustration. When the release paper is conveyed to under a coating device 3, the coating device 3 evenly coats the release paper with a water based resin finishing material, and the treated release paper is immediately conveyed to a drying device 4, where a partly cured surface layer is formed on the surface of the treated release paper. Wherein, in a preferred embodiment of the present invention, the temperature in the drying device 4 is between 70° C. and 130° C. As shown in FIG. 2 which is a sectional view along the A-A direction of FIG. 1, 101 stands for the release paper, 102 stands for the surface layer. After the drying process, the surface layer and release paper continue to be conveyed forward via a conveyor roller 5.

The second stage: to coat the partly cured surface layer with a reactive solvent-free multicomponent polymer utilizing a multicomponent reaction injection molding device 6 and a multicomponent automated mixing spraying self-cleaning spray gun in a sealed spray chamber system 8, after which the foaming reaction starts immediately, thereby forming the foaming layer, surface layer and release paper as shown in FIG. 3, wherein 103 stands for the foaming layer.

In a preferred embodiment of the present invention, the reactive solvent-free multicomponent polymer includes various proportions of polyurethane (PU) family materials which are widely used in the coating process, whose raw materials do not contain any added solvent. Obviously, according to the revealed contents of the preferred invention, the multicomponent polymer may be other reactive polymers. The preset proportions of various component materials of the multicomponent polymer are mixed together in a multicomponent reaction injection molding device 6. The mixture then is injected into the mold at a certain pressure using an impinging mix and is subsequently coated on the partly cured surface layer using an automated spray gun, thereby a foaming layer is formed. The multicomponent reaction injection molding device 6 and the multicomponent automated mixing spraying self-cleaning spray gun have been widely applied in the automotive industry, so their detailed structures and working principles are not repeated here.

In the above stage, firstly, a component material A which is in semi solid or solid state at room temperature is heated up using a preheating tank, and is conveyed to the corresponding tank for storing "A". Then A along with other component materials are measured, temperature controlled, pressurized, conveyed via a speed-adjustable ratio-variable high-precision pump and a heat-preserved even-transportation conveyor system, during which the operating temperature is between 30° C. and 80° C. Herein the component material A is preferably a polyol blend.

Secondly, the treated mixture is conveyed to a spray gun, and then is injected into the mold of the spray gun using an impinging mix. In the meantime the spray gun performs mix, spray and self-clean tasks. A graphic operations control center 7 is the smart operations interface for controlling the multicomponent reaction injection molding device 6 and the spray gun, which is also the control system of the entire assembly line. In the preferred embodiment of the present invention, a graphic operations control center 7 comprises of a PLC control system, a user-machine interface and other related execution and sensor systems, which are used to perform control tasks for the entire assembly line, such as start or stop rolling of the conveyors, running of the multicomponent reaction injection device, alarming, troubleshooting, etc. Different PLC system programs may be developed to perform various tasks according to practical production needs, which are not listed here. In another preferred embodiment of the present invention, there are two sets of multicomponent reaction injection molding (RIM) devices 6, and the applied coating mode of the spray gun is the dual-gun reciprocating overlay mode, thereby increases the straight-line speed of the assembly line and productivity. Furthermore, in case of the failure of one of the multicomponent reaction injection molding device, the production process may not be affected by adjust the coater running speed. In addition, according to the practical needs, the coating mode of the spray gun can be set to mono-gun full overlay mode, multi-gun multi-column overlay mode, mono-gun reciprocating overlay mode, dual-gun reciprocating overlay mode, etc. A sealed spray chamber system 8 further to include a ventilator 9 fixed on the ground, which performs downward vertical ventilation uniformly through a filter at the top, thereby the surface layer is coated uniformly with the mixed polymer. While the polymer that not falling on the surface layer is carried by the air flow and comes to rest against a baffle plate. And the rest of the polymer which is through the baffle plate deposits in a sedimentation tank because of gravity, and then is absorbed by a cotton filter. Thus the atomization and the uniform reaction of the polymer are ensured, while the loss of the material is minimized.

The third stage: at a scheduled time, to unwind the substrate around a shelf 10, then convey the unwound substrate along a scheduled direction via a conveyor roller 11. Between the polymer foaming stage and curing stage, the substrate, foaming layer and finished surface are put together to go through a roller press device 12 at the same time, which fits the substrate onto the foaming layer evenly and tightly, thereby once molding presses the substrate, foaming layer, surface layer and release paper together as shown in FIG. 4, wherein 104 stands for the substrate. The substrate may be fabric, nonwovens, micro fiber or fiber-like, etc. In a preferred embodiment of the present invention, the substrate is preferably micro fiber.

The fourth stage: to continue to convey the substrate, foaming layer, surface layer and release paper produced at the end of the previous stage forward to an oven 13, where the leather-like product becomes matured through circulation convection heating. Then the product is allowed to cool down by the cold air in a cold air chamber 14. Finally, the release paper is removed at a spot 16 shown in FIG. 1, and then the finished artificial leather or leather-like product is wound around a shelf 17, in the meantime, the removed release paper is wound around a shelf 19. In the preferred embodiment of the present invention, the temperature in the oven 13 is between 70° C. and 130° C. The product is heated up in the oven 13 using a preferably energy saving way of electric heating circulation thermal convection, whose parts comprises of a hot wind curtain, a hot air circulation system, a pressure balanced filter, etc. In the oven 13, a barrier is formed by the fast air current blew via the wind curtain, which prevents the hot air inside the oven 13 to overflow and the cold air outside to enter. The heat drying process is a cycle process, which begins with hot wind supplied through a pressure balanced air duct at the top by a combined cycle unit. Then after the product is heated up, the hot air comes through the air duct back to the combined cycle unit again, where it is reheated by an automated heating device whose starting and stopping are controlled by a temperature sensor. And an air volume adjusting valve fixed at the tuyere is used to ensure the uniformity of vertical air flow and the uniformity of temperature. Although the above embodiment of technical solution of the present invention is detailed, it is not difficult to understand that the above embodiment is only a specific example of many embodiments of the present invention, and it should not be considered as all embodiments of technical solution of the present invention, or the embodiment of technical solution limits or restrictions of the present invention. The present invention includes all obvious changes made according to the technical solution of the present invention, such as the change of the running coating mode of the sealed spray chamber system, e.g. mono-gun reciprocating overlay mode; the change of the heating temperature for the substrate, foaming layer, surface layer and release paper in the oven 13 according to actual situation; the change of the layer combinations of the once molding artificial leather or leather like, e.g. a layer combination of the foaming layer and surface layer.

Compared with the existing techniques, the automated assembly line for manufacturing ecotypic artificial leather or leather-like in the present invention has the following advantages and achievements:

The present assembly line solves the existing environmental and safety issues in the production of artificial leather or leather-like by achieving zero emissions of VOC and not using any flammable solvent-containing binding agent. It avoids the investment in expensive waste, such as gas, water, etc., treatment equipment and the high energy consumption pollution boiler. It makes it completely possible that a clean and safe production process, which meets the green and ecological production requirements.

The present assembly line overcomes the equipment and technical problems of applying automated coating technique for manufacturing artificial leather or leather-like with 100% solid content polymer materials.

The present assembly line applies a sealed ventilation spray chamber system with constant temperature and humidity, which makes the work environment stable in terms of temperature, humidity and air flow, and ensures the multicomponent polymer mixture foaming react evenly, thereby let the finished product have the best properties and the most stable quality.

The present assembly line applies the reactive materials and energy saving electric heating circulation thermal convection oven, which reduces the average energy consumption for each manufactured artificial leather or leather-like product.

The present assembly line makes possible once molding manufacture of artificial leather or leather-like, and the production and combination of the substrate, foaming layer and surface layer on one assembly line, thus the production costs, such as costs of plants, equipment, labours, resources, etc., are reduced.

The present assembly line increases the degree of automation in production of artificial leather or leather-like, ensures the accuracy of operations, has a high degree of intra-cooperation, has high productivity and is easy to industrialize.

What is claimed is:

1. A method for manufacturing artificial leather comprising the steps of:

utilizing a conveyor to convey a release paper having predesigned grains along a predesigned direction, utilizing a spray coating device to spray coat the release paper with a water based finishing material, drying the spray coated release paper in a drying device to form an incompletely solidified surface layer on the release paper, spray coating the incompletely solidified surface layer with reactive solvent-free multicomponent polymers to form a foaming layer on the surface layer using a multicomponent spray reaction injection molding (RIM) device and special spray guns which perform mixing, spraying and cleaning at the same time in a closed spray chamber system, delivering a substrate layer by a conveyor, pressing the substrate layer, the foaming layer in which foaming and coagulating of the multicomponent polymers are still occurring, and the incompletely solidified surface layer to bond them together as a laminate by using a roller, heating the laminate to completely solidify the substrate, foaming layer and surface layer together as an integral laminate, cooling the laminate after heating, and stripping the release paper from the surface layer to form the artificial leather.

2. The method for manufacturing artificial leather according to claim 1, wherein said multicomponent polymers belong to a polyurethane family and there is not any solvent in the multicomponent polymers.

3. The method for manufacturing artificial leather according to claim 1, wherein the spray foaming step further includes:

heating up a component material A of the multicomponent polymers which is in a semi solid or solid state at room temperature in a preheating tank, and then delivering the preheated component material A along with other component materials of the multicomponent polymers to the spray guns, wherein an operating temperature is between 30° C. and 80° C.

4. The method for manufacturing artificial leather according to claim 1, wherein the spray guns are multicomponent automated mixing spraying self-cleaning spray guns.

5. The method for manufacturing artificial leather according to claim 1, wherein the closed spray chamber system is maintained at constant temperature and humidity and provides a constant air flow.

6. The method for manufacturing artificial leather according to claim 1, wherein the spray foaming step further includes:

evenly ventilating vertically downward by a ventilator fixed on the ground, which facilitates coating the surface layer uniformly with the multicomponent polymers which become the foaming layer, wherein the multicomponent polymers are applied in an atomized form.

7. The method for manufacturing artificial leather according to claim 1, wherein the process of solidifying and stripping is accelerated by applying circulation thermal convection in an electric oven with an operating temperature between 70° C. and 130° C.

* * * * *